US009430912B2

(12) United States Patent
Whelan

(10) Patent No.: US 9,430,912 B2
(45) Date of Patent: Aug. 30, 2016

(54) UNITY REEL GAMING MACHINE AND METHOD OF PLAY

(71) Applicant: Incredible Technologies, Inc., Vernon Hills, IL (US)

(72) Inventor: Daniel John Whelan, Schaumburg, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 162 days.

(21) Appl. No.: 13/973,141

(22) Filed: Aug. 22, 2013

(65) Prior Publication Data

US 2014/0057695 A1 Feb. 27, 2014

Related U.S. Application Data

(60) Provisional application No. 61/692,505, filed on Aug. 23, 2012.

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/326* (2013.01)

(58) Field of Classification Search

CPC ..... G07F 17/34; G07F 17/326
See application file for complete search history.

(56) References Cited

U.S. PATENT DOCUMENTS

| | | | | |
|---|---|---|---|---|
| 2002/0014740 | A1* | 2/2002 | Ainsworth | G07F 17/3244 273/139 |
| 2003/0092480 | A1* | 5/2003 | White et al. | 463/20 |
| 2004/0043812 | A1* | 3/2004 | Ellis | G07F 17/34 463/20 |
| 2006/0116195 | A1* | 6/2006 | Baerlocher et al. | 463/20 |
| 2007/0060344 | A1* | 3/2007 | Watkins | G07F 17/3244 463/31 |
| 2011/0256918 | A1* | 10/2011 | Yang | 463/20 |
| 2013/0053122 | A1* | 2/2013 | Spark-Stahl | G07F 17/34 463/20 |
| 2013/0273997 | A1* | 10/2013 | Stewart | 463/21 |
| 2014/0141860 | A1* | 5/2014 | Meyer | G07F 17/3258 463/21 |

* cited by examiner

*Primary Examiner* — Pierre E Elisca
*Assistant Examiner* — Carl V Larsen
(74) *Attorney, Agent, or Firm* — Husch Blackwell LLP; George S. Pavlik

(57) ABSTRACT

A gaming machine and method featuring a plurality of matrices and a common game position or reel separate from, and positioned between, the plurality of matrices. Each of the plurality of matrices have a plurality of game positions and the plurality of matrices and common position are configured to display a game element selected from a population of game elements. During play of the game the game, the game positions and common position are randomly populated with game elements to form a configuration of game elements. The configuration of game elements forming predetermined winning and non-winning outcomes. The game element populated at the common position being evaluated in combination with game elements of adjacent game positions on the plurality of matrices in determining whether a winning outcome has resulted.

12 Claims, 5 Drawing Sheets

UNITY REEL GAMING MACHINE AND METHOD OF PLAY

CROSS REFERENCE TO RELATED APPLICATION

This application claims the benefit of U.S. Provisional Patent Application Ser. No. 61/692,505 filed Aug. 23, 2012, the entirety of which is incorporated herein by reference.

FIELD

The invention pertains to a gaming machine and method of play. More particularly, the invention pertains to such machines and methods which implement a game featuring a plurality of game matrices configured about a common game position that can be evaluated together with game positions on the plurality of matrices to identify winning outcomes.

BACKGROUND

Gaming machines for playing matching games are generally well known and have been relatively popular for a number of years. Typical mechanical reel or video slot machines are an example of such gaming machines. As is customary with such machines, a display is usually provided which presents a single two dimensional array having a series of game positions. During play of such games, elements or symbols are variable at the particular game positions and will eventually stop with a set of symbols or elements in a particular fixed position relative one another. Typically, where a preselected collection of game elements span across a game line, a winning outcome is obtained.

As is generally known, the nature and format of such games have certain limitations with respect to the number and presentation of winning and non-winning outcomes. Specifically, the outcome of such games is determined by evaluating whether certain predetermined configurations of elements or symbols are selected and presented relative one another on a single array or game matrix. For example, winning outcomes are usually produced when a set of identical symbols are presented in horizontal and/or vertical alignment across the individual game array. In light of such limitations, the number of possible outcomes, and possible winning outcomes in particular, is largely limited by the random selection of game elements on a single game array. Such outcomes are further limited by the two-dimensional proportions (height and/or width) of the game array.

It has been recognized that due to such limitations, player interest in such games can decrease over a period of time which may result in certain individual players deciding to cease playing the game and/or decline to play such machines again in the future. In settings where players are allowed to place wagers on the outcome of such games and such wagers generate revenue for the gaming establishment, it is generally undesirable to have a game that is not frequently played. Hence, there are on-going needs to try to bring play variations to the audience of players in order to sustain their interest and desire to continue playing.

DETAILED DESCRIPTION

Figure 1:
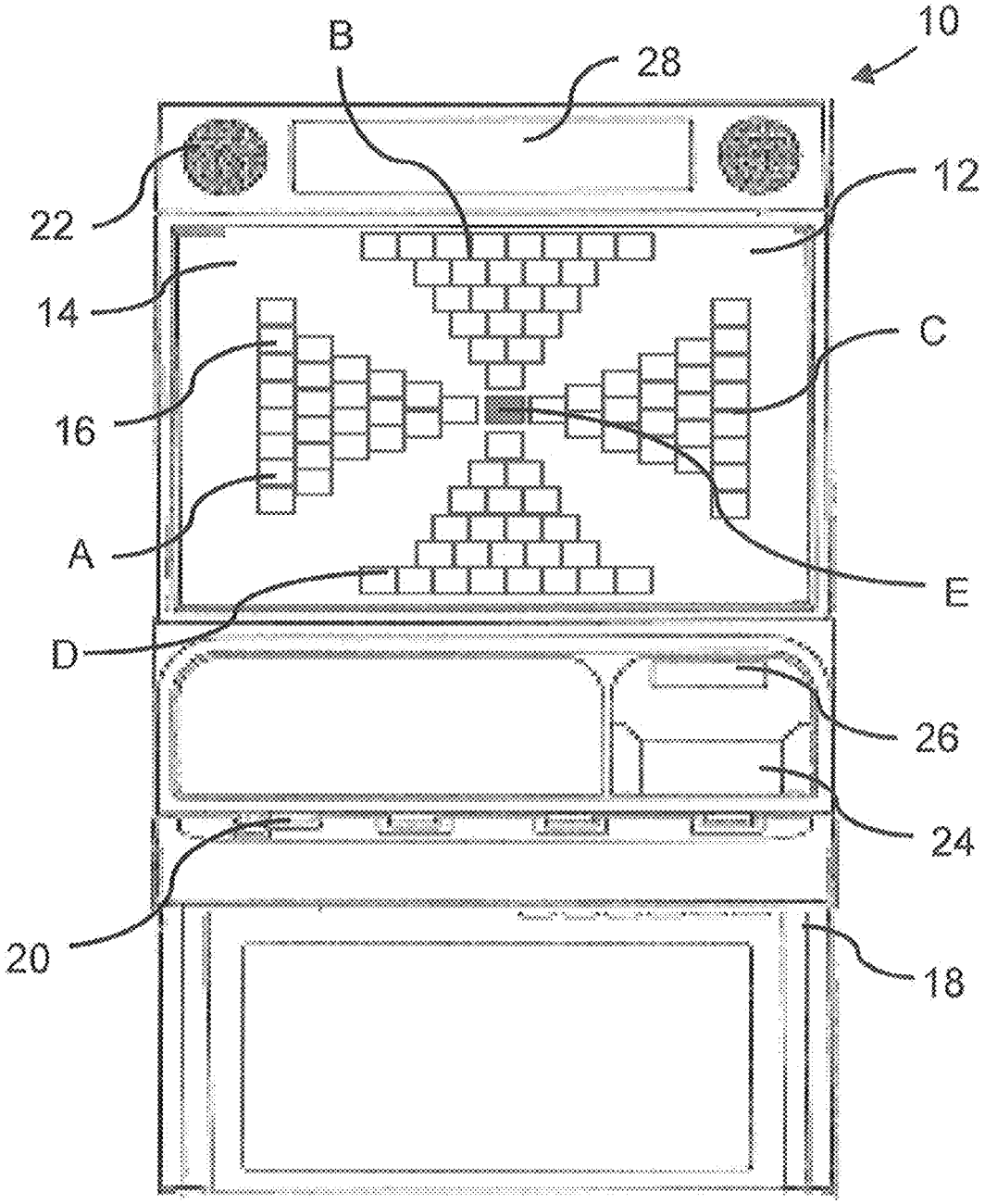
FIG. 1 is a front elevational view of a gaming machine presenting a game in accordance herewith.

While this invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated. For example, although embodiments described herein set forth a game presented on a gaming unit of the type usually referred to as an electronic "slot machine," the subject embodiments are not limited to such and can be applied for use in connection with any gaming machine or system, without limitation. Such systems can include, for example, mechanical reel gaming machines, coin-operated amusement devices, bar-top amusement devices, home gaming systems, video poker machines, or any other appropriate system.

As described herein, the embodiments of the subject invention are directed towards a matching game suitable for play on a gaming machine featuring at least one game display. According to such embodiments, the display can present a two-dimensional game array having a plurality of two-dimensional matrices with each matrix having a plurality of adjacent game positions. The display can additionally present at least one common game position or reel that is not part of any of the individual matrices. Generally, it is preferred, but not required, that the common game position is centrally located between or adjacent the individual matrices.

During play of the game, the game positions of the matrices and the common game position are populated with a set of symbols or elements randomly selected from a population of game elements. When the game positions are finally populated with a fixed set of symbols or elements, the final configuration of game elements can be determinative of the outcome of the game. For instance, when a particular set of related symbols or elements are aligned in a particular configuration, according to the rules of the game, the set of related game symbols can produce a predetermined "winning" outcome.

According to embodiments presented herein, such winning configurations can extend across the center game position from one matrix to another, or can be formed in a single matrix. In addition, winning configurations can be formed from horizontal, vertical or diagonal alignment of related game symbols, the formation of a particular geometric pattern of related game symbols, or combinations of any such configurations. Thus, according to such embodiments, the number of possible permutations of winning outcomes can be higher than games featuring a single game matrix.

It will be recognized that the subject invention can provide a more entertaining and dynamic gaming experience by providing a gaming machine and method with a new and more visually appealing presentation in connection with a matching game. Specifically, embodiments presented herein can offer players the opportunity to play a matching game that can provide greater numbers of winning outcomes. It will be recognized that such benefits can heighten player enjoyment and entertainment and can generally induce a player to continue playing the game and/or select the game over other competing games in the future. It will be further understood that other benefits and advantages of the invention will become apparent in the following disclosure.

Referring now to the figures, FIG. 1 illustrates a gaming machine 10 having a monitor or display 12 for presenting a game array 14 according to embodiments disclosed herein. As shown in FIG. 1, the game can be played on an array 14 featuring a plurality of matrices A, B, C, D with each matrix having a plurality of game positions 16. The array 14 can additionally feature a common game position E. In the embodiment illustrated in FIG. 1, game positions 16 and common game position E are shown as having a rectangular shape and the game matrices A-D as having a pyramidal configuration. Persons of ordinary skill in the art will understand, however, that game positions 16, common position E and game matrices A-D can have alternate sizes, shapes or configurations. Moreover, although FIG. 1 shows the game array 14 as having four matrices A-D, the game can have more or less matrices as desired, such as for example two matrices (e.g. A and C), without departing from the novel scope of the subject invention. In addition, embodiments presented herein can provide multiple common game positions E if desired.

As illustrated in FIG. 1, the gaming machine 10 can additionally feature a cabinet or housing unit 18 which generally surrounds the machine's interior components. The cabinet 18 can include a control array 20, such as for example, a keypad, touch-screen, or one or more buttons, switches or levers, and can additionally feature one or more speakers 22 for broadcasting audio sounds generated by the game. The machine 10 can additionally include features for accepting wagers and granting monetary awards, such as for example a coin tray 24, and/or one or more money or credit acceptors 26, such as a coin, bill or ticket acceptor, or a card reader.

At least one electronic display or monitor 12 can be visible though the cabinet 18 or can be affixed to the exterior of the cabinet 18. The display 18 can generally be used for visually presenting the game and other pertinent game information to a player. The display 12 can be a CRT, high resolution flat-panel LCD, plasma/LED display or other conventional electronically controlled video monitor. Although not shown in FIG. 1, the machine 10 can additionally include one or more secondary video displays or monitors that can present additional elements of the game, a bonus game, ancillary game information, pay tables, artwork and/or advertisements. Such secondary video displays can also be an LCD, plasma/LED or CRT display device that can present dynamic electronic images. It will additionally be recognized that display 12 and other secondary displays can have touch-screen capabilities in order to enable players to input or control certain aspects or features of the game.

In addition to a dynamic video display, the machine 10 can have additional lighting devices 28 that can be used in connection with backlit acrylics having static images that are illuminated from behind by one or more light sources. Such lighting devices 28 can be positioned on the front or sides of the cabinet 18 or can be physically mounted to the cabinet 18 as in the case of an electroluminescent topper. Images projected by such lighting devices can present identifying information regarding the game, advertisements, artwork and/or pay tables.

Figure 2A:
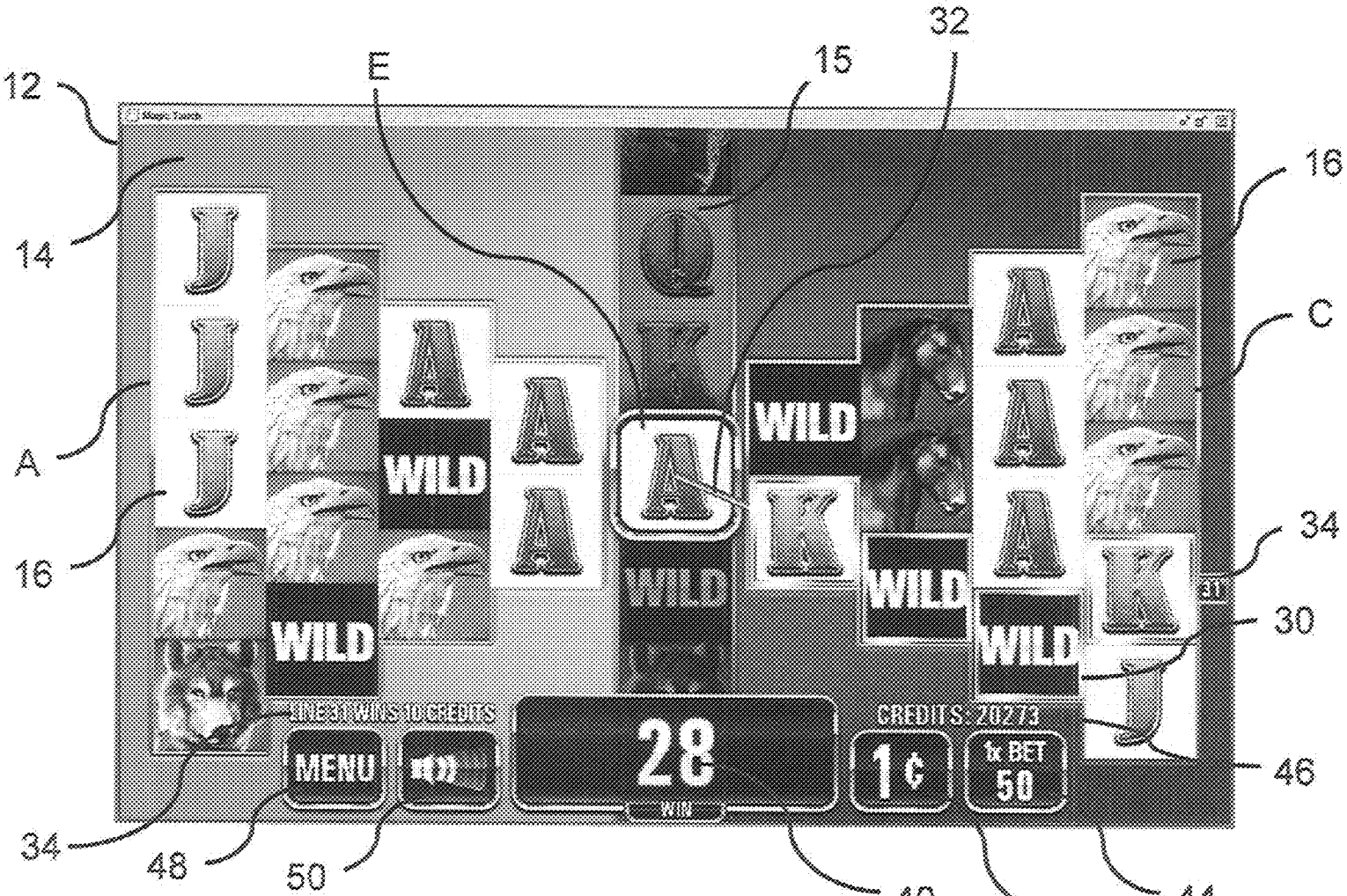
FIG. 2A illustrates a first sample configuration of a game as displayed on a gaming machine in accordance herewith.
Figure 2B:
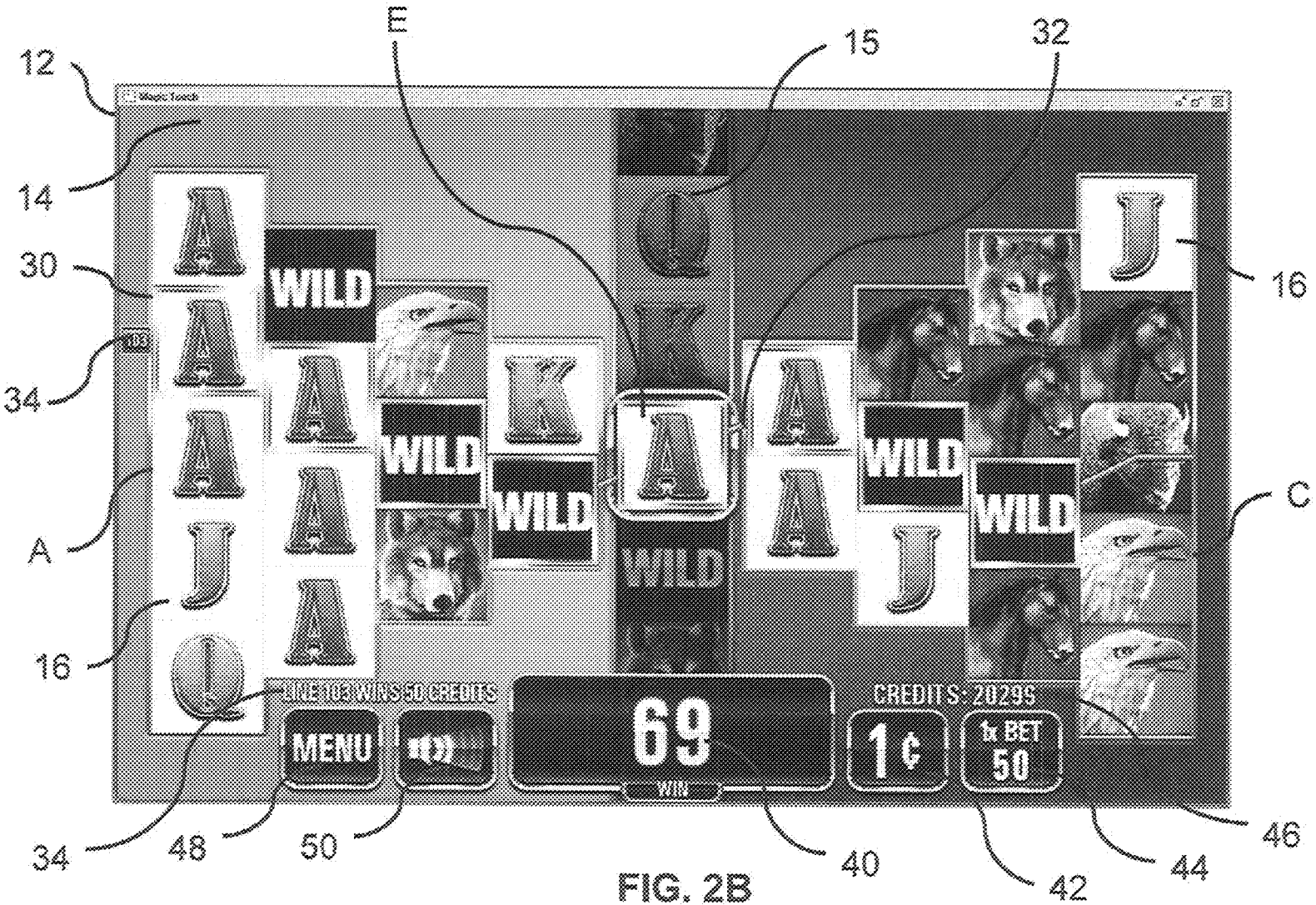
FIG. 2B illustrates a second sample configuration of a game as displayed on a gaming machine in accordance herewith.

FIGS. 2A and 2B illustrate exemplary game arrays 14 according to embodiments presented herein. According to such illustrated embodiments, the array 14 has first and second matrices A, C adjacent the common game position E. It will be recognized that embodiments of the subject invention are not limited to two matrices and can include more or less matrices as desired. In addition, although FIGS. 2A and 2B show matrices A, C horizontally adjacent to the sides of the common game position E, it will be understood that the matrices could be located at any position relative the common game position E.

During play of the game, the game positions 16 of the plurality of matrices A, C can be randomly populated with game elements or symbols. Such population can be performed by mechanical reels or by electronic means, or a combination thereof. For instance, the machine 10 can include a scrolling line or mechanical reel 15 that revolves until it stops with a particular game element displayed in the common game position E. Alternatively, game elements can be electronically variable at the common position E and the game positions 16 of the plurality of matrices A, C. Prior to populating the game positions 16 and common game position E, the display 12 can present game elements alternating or fluctuating at the game positions 16 and common game position E in order to increase excitement and provide a more entertaining and engaging gaming experience. For example, the array 14 can electronically present game elements capable of populating the common game position E on a scrolling line 15 that is visually illustrative of a rotating mechanical reel. During population of the common position E, the scrolling line can move in a horizontal or vertical direction until it stops with a particular game element at the common position E.

FIGS. 2A and 2B show the game elements as including letters (e.g., A, J, K), animal images (e.g., wolf, horse, eagle) and "WILD" characters. It will be understood, however, that game elements can take any number of alternate forms and have alternate or additional properties without departing from the novel scope of the subject invention. Such forms can include, without limitation, alpha-numeric characters, photos, figures, animals, symbols, colors, patterns, structures or any other recognizable image that can be visibly presented to players. For ease of describing the embodiments shown in FIGS. 2A and 2B, the "WILD" element will be designated as a common element which, according to the rules of the game, can be considered to be any game element in determining whether a winning outcome has been produced.

As shown in FIGS. 2A and 2B, the elements at the game positions have been randomly varied and the game has resulted in a fixed configuration of game elements across matrices A and C and at common position E. FIG. 2A shows a first sample configuration of game elements as displayed on array 14 after a play or pull of the game has randomly populated game elements at game positions 16 of matrices A and C and at common game position E. In this example, the rules of the game provide for a series of five or more letters in adjacent game positions to be associated with a predetermined winning outcome. The rules in this example further provide that the game element of common position E to be evaluated in connection with the game elements of matrix A or matrix C to determine whether a predetermined winning outcome has been produced. It will be recognized that although the common position E can be part of a winning outcome, it is not required to be and winning outcomes can be formed from by predetermined groupings of elements on a single matrix A, C.

In FIG. 2A, it will be recognized that a winning configuration has been produced from an alignment or chain of symbols in matrix C coupled with the central element E (i.e., K, WILD, WILD, K, A (central element) (from right to left)). It will be understood that while the winning configuration shown in FIG. 2A is comprised of five related symbols, winning configurations can require alignment of more or less symbols, or an arrangement, chain or grouping of varied symbols in a particular predetermined configuration. In addition, although a winning configuration can require an alignment of a predetermined minimum number of symbols, an alignment of additional related symbols can produce additional winning configurations or an increased payout where a player has wagered on the outcome of the game. Thus, as shown in FIG. 2A, the game element at common position E produced a winning outcome that would not have been established by the configuration of game elements in matrix C alone according to the predefined rules.

FIG. 2B illustrates a second sample configuration of game elements as displayed on array 14 after a play or pull of the game has randomly populated game elements at game positions 16 of matrices A and C and at common game position E. In this example, the rules of the game provide for a series of five or more identical letters in adjacent game positions to be associated with a predetermined winning outcome. The rules in this example further provide that the game element of common position E be evaluated in connection with the game elements of matrix A and matrix C and that groupings of elements spanning matrices A C are to be evaluated together in determining whether a predetermined winning outcome has been produced across the matrices at the common position.

In FIG. 2B, it will be recognized that a winning outcome has been produced by an alignment or chain of game elements spanning across the common position E and joining the two matrices. Specifically, the winning outcome in FIG. 2B is comprised of game elements, from left to right (A, A, WILD, WILD) on matrix A; (A) at common position E; and (A, WILD, WILD) on matrix C. Thus, according to this embodiment, the game evaluates the game element at the common position in connection with game elements at adjacent game positions of both of the adjacent game matrices. In this case, a winning configuration of consecutive related game elements has occurred at game positions 16 that span across common position E.

Thus, where the rules of the game require an alignment of at least five consecutive game elements in adjacent game positions, common position E can contribute to producing a winning outcome across the game matrices A, C. Such a practice can result in a winning outcomes that would not have been established on the individual matrices by themselves. In addition, where a winning outcome is in fact independently produced on a single matrix and the game element in common position E extends the winning configuration, the game can provide for additional or increased awards.

As illustrated in FIGS. 2A and 2B, the array 14 can present game elements contributing to a winning outcome in a particular manner in order to better inform the player that a winning outcome has been produced. For example, the game positions forming the winning outcome in FIGS. 2A and 2B are shown as having a more distinctive and defined border 30. In addition, where the game element in common position E has contributed to a winning outcome in a single matrix (FIG. 2A) or across matrices (FIG. 2B), a line 32 between common position E and an adjacent game position can be presented in order to further inform a player that the game element in common position E has contributed to the winning outcome. The array 14 can additionally present a text-based message 34 identifying that a winning outcome has been produced at a particular location on the array 14 and the number of credits that have been won. Such visual indications, are just a few examples of how the game can present a winning outcome. Persons of ordinary skill in the art will understand that other types of graphics and/or audio or visual signals or elements can be similarly used for purposes of signifying to a player that play of the game has resulted in a winning outcome.

The array 14 can additionally present additional gameplay information to a player such as the number of games played or total credits won 40, the amount of money or number of credits wagered on a single play 42, whether a wager has been increased by a particular multiplier 44, or the amount of money or number of credits available which have been deposited into the machine 46. The array 14 can additionally present icons or other images, symbols or icons 48, 50 that display certain ancillary settings, such as for example the volume level of the game's audio effects. Such indicia 48, 50 can be touch-screen enabled so as to allow the player to view and/or control or adjust certain features of the game, such as for example or the format of the game, such as the addition or deletion of matrices or the size of the matrices. Such indicia 48, 50 when actuated can present a separate menu or table 48 with certain gameplay options that the player can select and/or customize.

Figure 3:
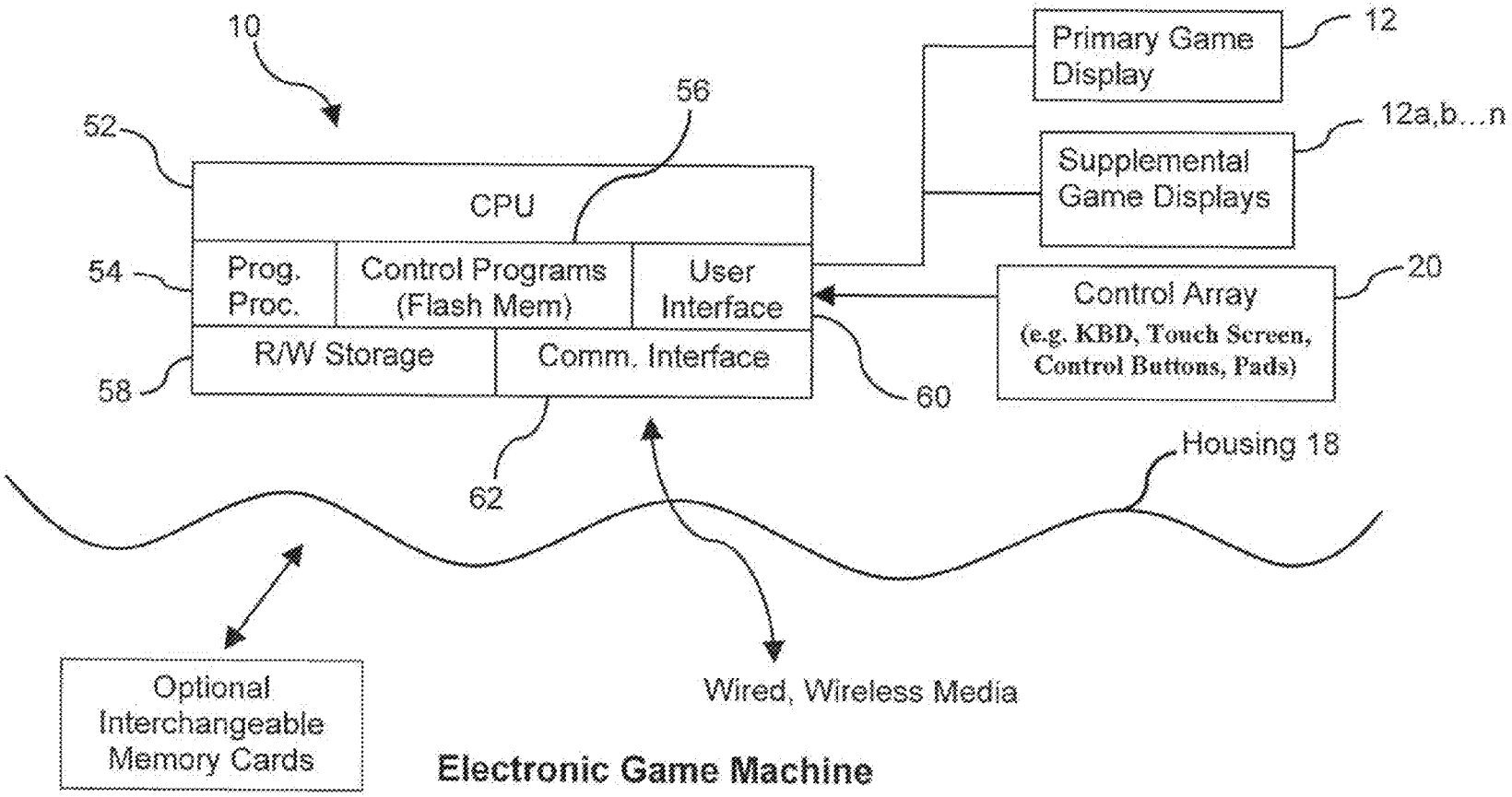
FIG. 3 is a block diagram illustrating a representational view of a gaming machine in accordance herewith.

FIG. 3 illustrates a representational view of the components of the gaming machine 10 according to embodiments of the subject invention. The gaming machine 10 can include a computer 52 with control circuitry, at least one electronic game display 12 and control array 20. The computer 52 can have a programmable processor 54, memory 56, a storage unit 58 and user interface 60. In addition, the memory 56 can include a main memory containing dynamic information processed by the programmable processor 54 during operation, and/or a static memory which contains fixed information, such as an operating system, game programs, and configuration information necessary for the processor 54 to process input from the player through the control array 20.

Embodiments of the subject invention further provide that the control array 20 can be implemented as one or more of a keyboard, mechanical lever, a touch-screen, buttons or pads and/or any other means for control or desired combination of controls able to accept input from a player and produce output to the game display 12 in response to a player's input. Additionally, the gaming machine 10 can incorporate one game display 12, or multiple game displays 12*a,b . . . n* without departing from the novel scope of the invention.

The gaming machine 10 can additionally include a communication interface 62 to communicate information regarding the game to another electronic device, such as for example a database, server, computer or handheld device. Such communications can enable players on different machines to play the game together or to compete against one another. It can further enable designers, technicians and operators to assess, monitor and record analytical information about the game, the players and/or the machine itself. This can result in easier and faster repair, maintenance or updating of the game or machine, and can further contribute to a better understanding of the way in which it is played for purposes of improving future game play. Such communication can be processed via a remote or local area network and can be wired or wireless.

While various processes for evaluating the outcome of a game come within the spirit and scope of the present invention, in one exemplary embodiment, the computer 52 can contain within its static memory 56 either an algorithm for examining a particular outcome against a fixed set of rules to determine whether it is a winning outcome. Alternatively, a list or table of all possible winning outcomes can be provided and the particular outcome of a game can be compared to the stated winning outcome on the list or table. The computer 52 can additionally determine the outcome of a particular game using the rules stored in the static memory 56, and further recognize the outcome as a particular individual outcome. It is preferred, but not required, that individual winning outcomes have some reasonably obvious basis, whether it be elements having some common property being tangent to each other or an arrangement of similar elements or elements of a predetermined nature being grouped in some reasonably obvious configuration. It is further preferred that winning outcomes be either determinable by a known and consistent algorithm, or predefined and consistent such that a player can determine whether an individual outcome is a winning outcome, and if so, what the prize to be awarded for achieving that outcome will be.

Figure 4:
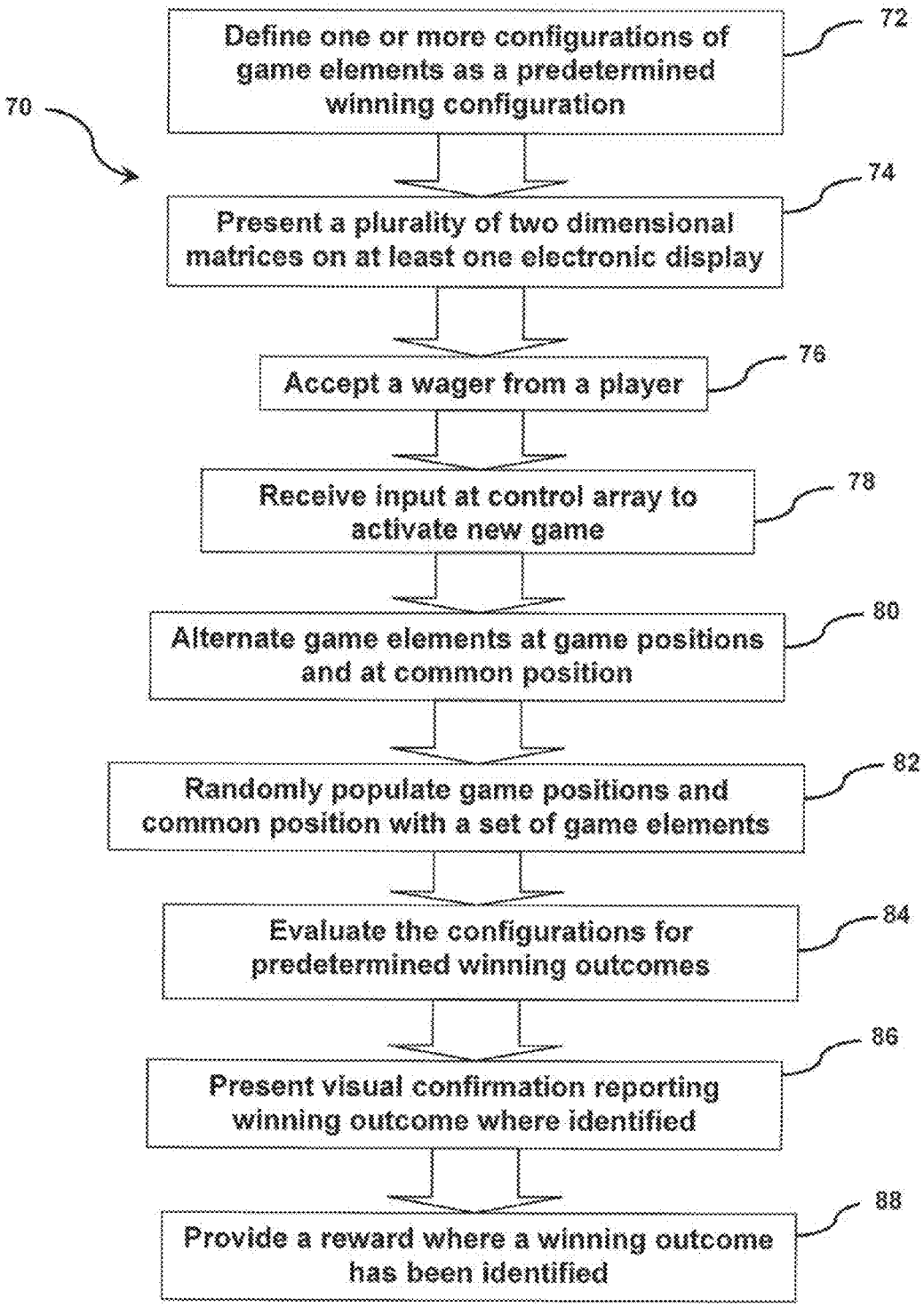
FIG. 4 is a flowchart showing a method in accordance with embodiments of the subject invention.

FIG. 4 is a flowchart illustrating a method 70 in accordance with embodiments of the subject invention. According to such method, one or more configurations of game elements can be defined 72 as a predetermined winning outcome according to the rules of the game. As is typical in the art, the game generally starts from some first configuration, typically the configuration produced by the particular individual outcome of the prior game. The machine 10 can visually present 74 on the electronic display 12 an array 14 having a plurality of matrices A-D, with each matrix having a plurality of game positions 16. The array can further include a common game position E that is independent of any of the plurality of matrices A-D.

In settings where the play of the game can be accompanied by wagering, the machine 10 can accept 76 money or credits from a player and the machine 10 can receive input 78 from a player at the control array 20 to activate a new game. Where the game is not accompanied by wagering, the machine 10 can be programmed to initiate a new game merely by receiving input 78 to activate a new game. During play, the display can alternate 80 game elements at the game positions 16 and/or common position E in order to provide a more entertaining an engaging gaming experience. The game can randomly populate 82 the game positions 16 and common position E with a set of game elements selected from a superset or population of possible game elements. The set of game elements populated in the game positions 16 and common position E form a configuration that the game can evaluate 84 the configuration of game elements to determine whether a predetermined winning outcome has been obtained. In evaluating the resulting configuration of game elements, the game can consider the arrangement of game elements spanning across the common position E from one matrix to another.

Where a winning outcome has resulted, the game display 12 can present 86 visual confirmation reporting or acknowledging the occurrence of a winning outcome, and where the machine 10 has accepted a wager, the machine 10 can provide 88 an reward to a player in the form of an actual payout of money, tokens or coins, or can update information presented on the display to reflect the quantity of the reward.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

What is claimed is:

1. A gaming machine for playing a game, the machine comprising:

a computer including a programmable processor, memory unit and control circuitry;

a control array;

means for accepting a wager on an outcome of the game;

at least one electronic display electrically coupled to the computer and control array, the display presenting a two-dimensional array having a plurality of matrices and a common game position separate from, and positioned between, the plurality of matrices, each of the plurality of matrices having a plurality of game positions aligned in a plurality of columns or rows with each column or row of a single matrix containing a different number of game positions, the number of game positions in each column or row increasing incrementally as the matrix extends away from the common game position, the plurality of matrices and common position each configured to display a game element selected from a same population of game elements; and during play of the game, the game positions and common position being randomly populated with game elements to form a configuration of game elements on the array, the configuration of game elements forming predetermined winning and non-winning outcomes of the game, the game element populated at the common position being evaluated in combination with game elements of adjacent game positions on the plurality of matrices in determining whether a winning configuration has been formed on a single matrix or between at least two of the plurality of matrices.

2. The gaming machine of claim 1 where the control array comprises a keyboard, mechanical lever, button or touchscreen.

3. The gaming machine of claim 1 where the electronic display is a CRT, LCD, plasma or LED display.

4. The gaming machine of claim 1 further comprising an exterior cabinet for housing the computer.

5. The gaming machine of claim 1 further comprising a communication interface coupled to the computer, the communication interface suitable for electronically transferring information between the computer and other electronic devices via electronic signals.

6. The gaming machine of claim 5 where the communication interface transfers information programs via wired or wireless signals.

7. The gaming machine of claim 1 further comprising means for providing a reward in connection with a predetermined winning outcome for a game.

8. The gaming machine of claim 1 further comprising means for visually distinguishing game positions forming a predetermined winning outcome from a remainder of game positions on the array.

9. The gaming machine of claim 1 where during play of the game, the array presents elements capable of populating the common game position on a scrolling line that is illustrative of a rotating mechanical reel.

10. A gaming machine for playing a game, the machine comprising:

a computer including a programmable processor, memory unit and control circuitry;

a control array;

means for accepting a wager on an outcome of the game;

means for providing a reward in connection with a predetermined winning outcome for a game;

at least one electronic display electrically coupled to the computer and control array, the display presenting a two-dimensional array having a plurality of matrices and a common game position separate from, and positioned between, the plurality of matrices, each of the plurality of matrices having a plurality of game positions aligned in a plurality of columns or rows with each column or row of a single matrix containing a different number of game positions, the number of game positions in each column or row increasing incrementally as the matrix extends away from the common game position, the plurality of matrices and common position each configured to display a game element selected from a same population of game elements; and during play of the game, the game positions and common position being randomly populated with game elements to form a configuration of game elements on the array, the configuration of game elements forming predetermined winning and non-winning outcomes of the game, the game element populated at the common position being evaluated in combination with game elements of adjacent game positions on the plurality of matrices in determining whether a winning configuration has been formed on a single matrix or between at least two of the plurality of matrices.

11. A gaming machine for playing a game, the machine comprising:

a computer including a programmable processor, memory unit and control circuitry;

a control array;

at least one electronic display electrically coupled to the computer and control array, the display presenting a two-dimensional array having a plurality of matrices and a common game position separate from, and positioned between, the plurality of matrices, each of the plurality of matrices having a plurality of game positions aligned in a plurality of columns or rows with each column or row of a single matrix containing a different number of game positions, the number of game positions in each column or row increasing incrementally as the matrix extends away from the common game position, the plurality of matrices and common position each configured to display a game element selected from a same population of game elements;

during play of the game, the game positions and common position being randomly populated with game elements to form a configuration of game elements on the array, the configuration of game elements forming predetermined winning and non-winning outcomes of the game, the game element populated at the common position being evaluated in combination with game elements of adjacent game positions on the plurality of matrices in determining whether a winning configuration has been formed on a single matrix or between at least two of the plurality of matrices; and means for visually distinguishing game positions forming a predetermined winning outcome from a remainder of game positions on the array.

12. A gaming machine for playing a game, the machine comprising:

a computer including a programmable processor, memory unit and control circuitry;

a control array;

at least one electronic display electrically coupled to the computer and control array, the display presenting a two-dimensional array having a plurality of matrices and a common game position separate from, and positioned between, the plurality of matrices, each of the plurality of matrices having a plurality of game positions aligned in a plurality of columns or rows with each column or row of a single matrix containing a different number of game positions, the number of game positions in each column or row increasing incrementally as the matrix extends away from the common game position, the plurality of matrices and common position each configured to display a game element selected from a same population of game elements; and during play of the game, the game positions and common position being randomly populated with game elements to form a configuration of game elements on the array, the configuration of game elements forming predetermined winning and non-winning outcomes of the game, the game element populated at the common position being evaluated in combination with game elements of adjacent game positions on the plurality of matrices in determining whether a winning configuration has been formed on a single matrix or between at least two of the plurality of matrices, the array presenting elements capable of populating the common game position on a scrolling line that is illustrative of a rotating mechanical reel.

* * * * *